US009634372B2

(12) United States Patent
Pike

(10) Patent No.: US 9,634,372 B2
(45) Date of Patent: Apr. 25, 2017

(54) APPARATUS FOR USE IN THE RECEIPT AND/OR TRANSMISSION OF DATA SIGNALS

(71) Applicant: Pro Brand International (Europe) Limited, Haslingden (GB)

(72) Inventor: Matthew James Pike, Radcliffe (GB)

(73) Assignee: Pro Band International (Europe) Limited, Haslingden (GB)

( * ) Notice: Subject to any disclaimer, the term of this patent is extended or adjusted under 35 U.S.C. 154(b) by 0 days.

(21) Appl. No.: 14/379,330

(22) PCT Filed: Feb. 18, 2013

(86) PCT No.: PCT/GB2013/050379
§ 371 (c)(1),
(2) Date: Aug. 18, 2014

(87) PCT Pub. No.: WO2013/121223
PCT Pub. Date: Aug. 22, 2013

(65) Prior Publication Data

US 2015/0035618 A1 Feb. 5, 2015

(30) Foreign Application Priority Data

Feb. 17, 2012 (GB) ..... 1202717.3

(51) Int. Cl.
*H01P 5/12* (2006.01)
*H01P 5/107* (2006.01)
*H01P 1/161* (2006.01)

(52) U.S. Cl.
CPC ..... *H01P 5/107* (2013.01); *H01P 1/161* (2013.01)

(58) Field of Classification Search
CPC ..... H01P 5/107; H01P 1/161; H01P 5/181; H01P 5/12
USPC ..... 333/137
See application file for complete search history.

(56) References Cited

U.S. PATENT DOCUMENTS 5,619,173 A * 4/1997 King ..... H01P 1/161 333/125
5,977,844 A * 11/1999 Baird ..... H01P 1/161 333/135

FOREIGN PATENT DOCUMENTS

DE 3111106 A1 9/1982
JP S6152001 A 3/1986
WO WO0070705 A1 11/2000

OTHER PUBLICATIONS

English Abstract of DE 3111106A1—Pub Date Sep. 30, 1982—Siemens AG.

(Continued)

*Primary Examiner* — Robert Pascal
*Assistant Examiner* — Kimberly Glenn
(74) *Attorney, Agent, or Firm* — Woodard, Emhardt, Moriarty, McNett & Henry LLP

(57) ABSTRACT

Apparatus is provided which allows for the receipt and/or transmission of data signals, and, for the received signals, for the subsequent separation of the same into at least two sets of data signals which are orthogonal and provide these sets of data signals to subsequent processing components, whilst maintaining the isolation between the first and second data signal sets. For the transmission of the data signals the first and second sets of data signals are initially separate and then combined into one data set to allow the same to be transmitted.

24 Claims, 3 Drawing Sheets

(56) References Cited

OTHER PUBLICATIONS

English Abstract of JP S6152001A—Pub Date Mar. 14, 1986—Fujitsu Ltd.
English Abstract of WO 00/70705A1—Pub Date Nov. 23, 2000—Marconi Communications GmbH.

* cited by examiner

APPARATUS FOR USE IN THE RECEIPT AND/OR TRANSMISSION OF DATA SIGNALS

REFERENCE TO RELATED APPLICATIONS

This application is the U.S. national stage application of International Patent Application No. PCT/GB2013/050379, filed Feb. 18, 2013, which claims priority of Great Britain Application No. 1202717.3, filed Feb. 17, 2012, the disclosures of each of which are incorporated herein by reference in their entirety.

The invention to which this application relates is for use in the receipt and/or transmission of data signals in predefined frequency ranges between one or more broadcast locations and one or more receiving locations, with the said signals relayed between said locations via one or more satellites or other transmission means such as cable.

At the said receiving and/or transmitting locations there is typically provided an antenna to which is fitted at least one Low Noise Block (LNB) and/or a Block up Convertor (BUC) and a waveguide which allows the received or transmitted data to be collated and ordered and then passed to further processing apparatus to allow the data to be provided to one or more receiving or transmitting apparatus for subsequent use in the provision of, for example, television, radio, internet and other auxiliary services.

Increasingly, there is pressure for the apparatus at the receiving and/or transmitting locations to be able to be used to receive data signals in different polarity formats and/or from one or more satellite and/or broadcast locations in an effective manner and without the need for a directly related increase in the apparatus which is required to be provided at the receiving and/or transmitting locations. There is also pressure to achieve this whilst keeping additional costs to a minimum due to the large number of receiving and/or transmitting locations required to be provided with said apparatus in order to allow the service to be provided.

Thus, the present invention relates to the need to be able to receive and/or transmit data signals in a common waveguide, rather than providing a separate waveguide and associated components for each of a plurality of distinct data signals and then be able to separate the distinct data signals and provide the same as separate feeds to the further processing components and to do so in a manner which allows interference between the separate feeds to be kept below an acceptable level to thereby ensure that the respective data signals are acceptable for subsequent processing and the quality of the subsequent data is acceptable.

Due to the abovementioned pressures and demands it has been known to provide apparatus which allows the receipt of a number of data signals and the subsequent separation and provision of separate feeds from the waveguide. One such known solution is illustrated in FIG. 1. In this Figure there is provided a waveguide A and two separate probes B, C depending away from the waveguide in the directions of arrows E,D respectively. Each of the probes is provided by a microstrip transmission line and each probe is provided to carry one of at least two sets of separated data signals which have differing orthogonal characteristics. Due to the fact that the respective microstrip probes are physically separated by being on opposing sides of the waveguide A and depend from the waveguide with a 90 degree offset it is found that the extent of separation between these probes is acceptable in terms of lack of interference and effectiveness of separating the data signals. However, the main problem which is experienced with this design is that of the physical distance between the probes when one considers that the next part of the passage of the data signals from the respective probes is for the signals to be processed by components mounted on a printed circuit board (PCB). One solution is to provide a separate circuit board for each of the probes, with a first PCB provided with the appropriate components for the data signals from probe B and a second PCB with the appropriate components for the processing of the data signals from probe C. However, space and cost constraints make this an unattractive proposition.

An alternative approach is to provide the necessary components on a common PCB and to provide paths on the PCB for the data signals from the respective probes B,C so as to allow the appropriate processing to be performed. However, the problem with this approach is that the distance between the probes means that the path for at least one of the data feeds to the components is relatively long and typically requires one or more jumper members to be provided on the PCB which is unattractive as a solution due to cost and also the complexity of manufacture of the board, and the greater possibility of problems being caused in subsequent operation due to the failure of the jumpers.

An alternative known approach is shown in FIG. 2 in which a waveguide A is again shown. In this case two probes, F,G, depend away from the waveguide to carry, respective sets of data signals which have been separated. In this case it will be seen that the microstrip probes are located significantly closer together than shown in FIG. 1 and therefore savings can be made in cost and also the complexity of the paths to the subsequent processing components on the PCB connected to the probes can be reduced. However it is found that in practice that the closeness of the probes, F,G causes interference between the data signal sets to such an extent that the subsequent processing of the sets of separate data signals is adversely affected and so the quality of the data which is subsequently provided is relatively poor and, in many cases, unacceptable.

An aim of the present invention is therefore to provide apparatus which allows for the receipt and/or transmission of data signals, and for the received signals, the subsequent separation of the same into at least two sets of data signals with different orthogonal characteristics and then provide those distinct sets of data signals to subsequent processing components, whilst maintaining the isolation between the two distinct data signal sets to an acceptable level. A further aim is to achieve this in a manner which is both cost effective and reliable. A yet further aim is to allow the combination of two data signal sets into one data set to allow the same to be transmitted.

In a first aspect of the invention there is provided apparatus for the receipt and/or transmission of Radio Frequency data signals, said apparatus including a waveguide to receive and/or transmit said data signals, said waveguide having at least first and second probes depending therefrom, said first probe provided to carry first data signals and said second probe provided to carry second data signals, distinct from the first data signals, means to substantially maintain the isolation between said first and second data signals as the same are passed to and/or from further processing components for the said data signals and wherein said waveguide includes a first end through which received and/or transmitted data signals pass into and/or from the same, and a second end spaced from the first end at, and/or adjacent to, which is provided at least one protrusion which is configured and located with respect to the said first and second probes so as to cause said first data signals to be separated and pass to and/or from the first probe and said second data signals to be separated and pass to and/or from the second probe.

In one embodiment the first and second data signals are orthogonal.

Typically at least one of the sets of first or second data signals pass through an aperture formed in a side of the waveguide. Typically both the first and second probes are located on the same side of the waveguide and typically lie in a common plane.

In one embodiment the first and/or second probes include a microstrip. When both probes include a microstrip the respective microstrips are oriented such that their respective longitudinal axes are offset, typically by 90 degrees.

In one embodiment the passage of the first data signals between the first probe and the waveguide is defined as being between the said second end of the waveguide and the first probe, typically via a microstrip, and the passage of the second data signals between the second probe and the waveguide is between a surface of the at least one protrusion and the second probe, typically via a microstrip.

Typically the respective microstrips are located on a common substrate. In one embodiment the substrate is a printed circuit board (PCB) which includes a portion which acts as a ground plane and provides at least a portion of a wall of the waveguide.

Typically the PCB includes a ground plane which is located to lie above the protrusion and towards the opening into the waveguide but below the aperture leading to the second probe. In one embodiment the said ground plane forms part of the lower wall of a chamber into which the said aperture leads.

In one embodiment the wall of the waveguide is used to form part of the ground plane with respect to the PCB and hence lies between the microstrips for the first and second probes.

In one embodiment the at least one protrusion is provided in the form of a bar, rod or plate which passes across the waveguide and which has an upper surface raised from the end of the waveguide.

Typically at least one protrusion is oriented such that it phase offsets the data signals of one set with respect to the other and hence allows the separation of the data signals with the respective first and second orthogonal characteristics.

In a further aspect of the invention there is provided apparatus for the receipt and/or transmission of Radio Frequency data signals, said apparatus including a waveguide to receive said data signals, said waveguide having at least first and second probes depending therefrom and located adjacently to each other.

In one embodiment a protrusion is provided within the waveguide to cause at least a second set of digital data to be deflected from the waveguide and into a separate chamber in which a probe to receive said data signals is located. In this embodiment the other of the probes protrudes partially into the waveguide.

In a further aspect of the invention there is provided apparatus for the reception and/or transmission of data signals, said apparatus including a waveguide, said waveguide having an opening at a first end and a second opposing, end wherein a protrusion is formed at or adjacent to said closed end to form a septum.

In one embodiment the said waveguide is a circular waveguide.

In one embodiment an aperture is provided in the waveguide for the reception and/or transmission of a second set of data signals over a fixed bandwidth which is orthogonally polarised from the bandwidth of the first set of data signals.

In one embodiment a printed circuit board is provided therein and includes a probe for the reception and/or transmission of the first data signals.

Typically the ground plane of the PCB is used as a waveguide wall for the second data signals.

In one embodiment the said aperture transitions to become a waveguide.

In one embodiment the waveguide has a 90° bend towards the PCB.

Typically the PCB includes a second probe for the orthogonal polarisation which transitions the waveguide signal to a microstrip signal.

The current invention provides transmission line apparatus including apparatus as detailed above.

Specific embodiments of the invention are now described with reference to the accompanying drawings wherein.

Figure 1:
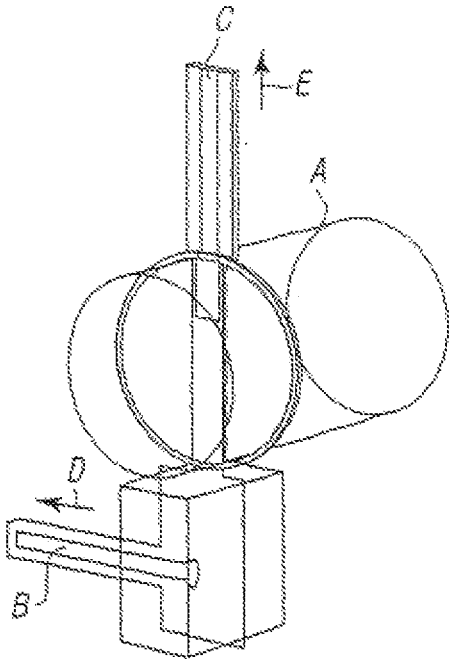
PRIOR ART FIG. 1
FIG. 1 illustrates a first example of prior art apparatus as previously described.
Figure 2:
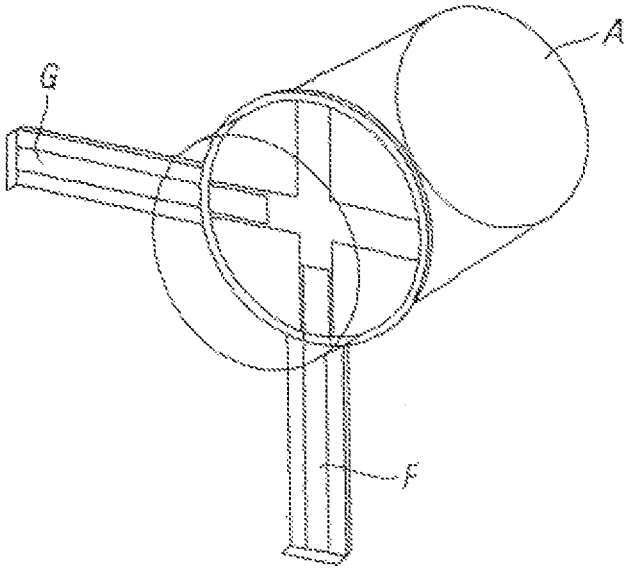
PRIOR ART FIG. 2
FIG. 2 illustrates a second example of prior art apparatus as previously described.
Figure 3:
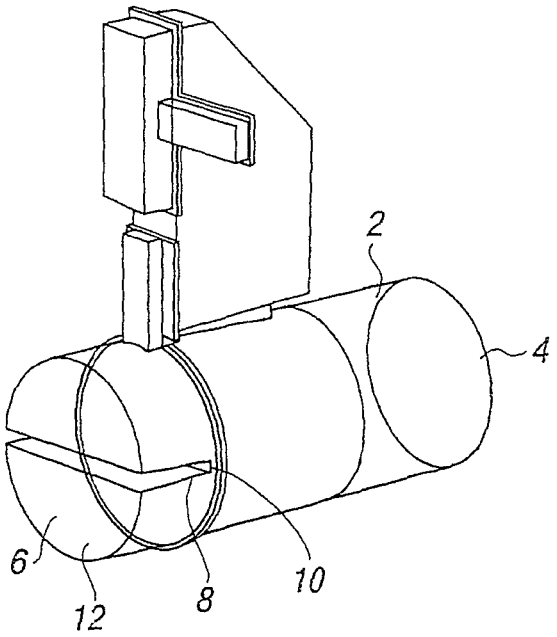
FIG. 3 is a perspective view of a waveguide and transition apparatus in accordance with a first embodiment of the invention.
Figure 4:
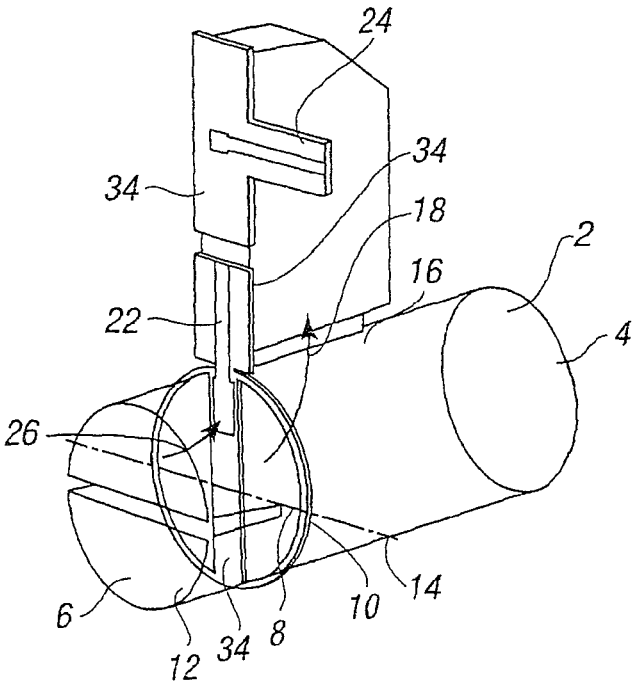
FIG. 4 is the same view as FIG. 3 with the interior components of the apparatus illustrated.
Figure 5:
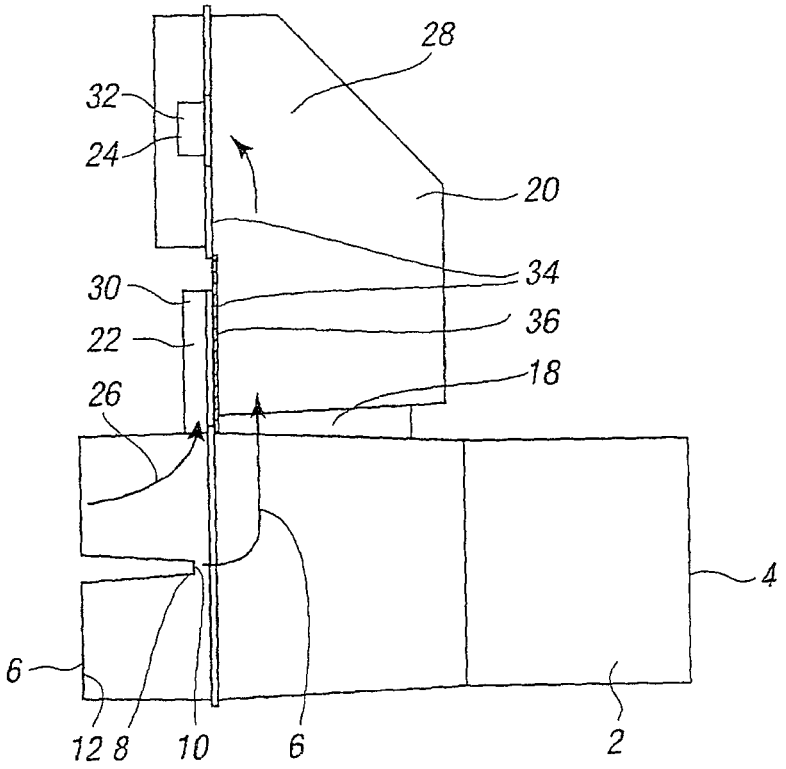
FIG. 5 illustrate an elevation of the apparatus shown in FIGS. 3 and 4.

Referring now to the FIGS. 3-5 there is illustrated apparatus in accordance with the invention including a waveguide 2 which has a first end 4 and an opposing end 6. The waveguide is provided as part of, in this embodiment, transmission line apparatus provided to receive data signals with the apparatus provided at each location which is required to receive the data signals. The apparatus typically includes an antenna connected to a Low Noise Block which is provided to receive data signals transmitted within one or more frequency bands via a satellite data transmission system. The received data signals are commonly used for the generation of audio, video and data and, in order to allow this to be achieved, the signals have to be converted from the format in which they are received into a format from which the audio, video and data can be generated.

Although the present invention can be used with data signals received in the Ku frequency band, and reference is made to the same herein, it should be appreciated that the invention as described and features thereof may be used with respect to data signals received in other frequency bands to the same advantage. The apparatus can also be used to transmit data signals in which case the path of the data signals which are herein described with reference to the FIGS. 3-5 will be reversed.

The waveguide 2 is provided as part of the receiving apparatus at the receiving location, and allows the passage of received data signals through the opening 4 to pass towards the second end 6. The aim is to be able to split the data signals into at least two sets of data signals which have different orthogonal characteristics and then allow the two sets of data signals to be passed in a substantially isolated manner to components which allow the further processing of the data signals in a desired manner. As the processing performed on the two sets of data signals are different then the sets are required to be connected to paths which allow the same to be directed to and processed by the appropriate components.

In the present invention, this is achieved by allowing the received data signals to pass towards the second end 6 at which there is located a protrusion 8. The protrusion in this example is provided in the form of a plate which has an upper surface 10 which is raised from the face 12 of the second end 6. Furthermore the plate is located such that it's longitudinal axes 14 is perpendicular to the direction 16 in which a second set of the data signals pass from the waveguide through an aperture 18 in the side wall of the waveguide. The dimensions of the protrusion 8 can be selected to suit the specific frequency bands of the data signals which are to be moved out of the waveguide and the required separation of the same but is formed such that the received data signals are split into at least first and second data signal sets which are correctly phased but are orthogonal.

The aperture 18 leads to a chamber 20 in which is located a second probe 24. A first probe 22 is located such as to receive first data signals which are deflected from the surface 12 of the second end 6 to pass to the first probe as indicated by arrow 26. The second data signals which have the different orthogonal characteristic to the data signals of the first set, are deflected from the upper face 10 of the protrusion 8 rather than the second end 6 and these data signals pass through the aperture 18 and into the chamber 20 in which they pass as indicated by arrows 16 and 28 to the second probe 24.

The probes 22, 24 each lead to a port 30, 32 respectively from which the data signals can be passed to further processing components as appropriate and located on the printed circuit board 34.

The probes are connected to a common PCB 34, part of which is illustrated in FIG. 5 and on which the paths and components are located for the subsequent processing of the data signals. A ground plane 36 is provided as illustrated in FIG. 5, from which a waveguide wall is formed and which bridges the gap between the parts of the PCB 34 to which the first and second probes 22, 24 are connected.

It should be appreciated that although the invention is described herein with respect to the reception of signals, the same apparatus can be used to transmit signals in which case the signals to be transmitted are passed from the probes 22, 24 into the waveguide and combined as they pass, in the opposite direction to the received signals, towards exit at the opening 4 of the waveguide to be transmitted therefrom to a remote location.

There is therefore provided in accordance with the invention a means of utilising a single PCB to provide processing components and paths for two separate sets of data signals with differing orthogonal characteristics which allow the same to be separated from the waveguide and then passed to processing whilst isolated.

The invention claimed is:

1. Apparatus for the receipt and/or transmission of Radio Frequency data signals, said apparatus including a waveguide to receive and/or transmit said data signals, said waveguide having at least first and second probes depending therefrom, said first probe provided to carry first data signals and said second probe provided to carry second data signals, distinct from the first data signals, said first data signals and second data signals passed to and/or from further processing components for the said data signals and wherein said waveguide includes a first end through which received and/or transmitted data signals pass into and/or from the same, and a second end spaced from the first end at and/or adjacent to, which is provided at least one protrusion which is configured and located with respect to the said first and second probes so as to cause said first data signals to be isolated from said second data signals, said first data signals separated from and passing to and/or from the first probe and said second data signals to be isolated from said first data signals, said second data signals separated from and passing to and/or from the second probe and wherein both the first and second probes are located on the same side of the waveguide and at least one of said sets of first or second data signals pass through an aperture formed in a side of the waveguide.

2. Apparatus according to claim 1 wherein the first and second data signals are orthogonal.

3. Apparatus according to claim 1 wherein the said first and second probes are positioned in a common plane.

4. Apparatus according to claim 1 wherein the first and/or second probes include a microstrip.

5. Apparatus according to claim 4 wherein microstrips are provided for both the first and second probes and are oriented such that their respective longitudinal axes are offset.

6. Apparatus according to claim 5 wherein said longitudinal axes are offset by 90 degrees.

7. Apparatus according to claim 4 wherein the respective microstrips are located on a common substrate on which the respective further processing components for the first and second data signals are located.

8. Apparatus according to claim 7 wherein the substrate is a printed circuit board (PCB) which includes a portion which acts as a ground plane and provides at least a portion of a wall of the waveguide.

9. Apparatus according to claim 8 wherein a portion of the wall of the waveguide forms part of the ground plane and which portion is located between the microstrips for the first and second probes.

10. Apparatus according to claim 7 wherein said substrate forms part of the wall of a chamber into which an aperture leads from the waveguide to allow the passage of the second data signals therein.

11. Apparatus according to claim 1 wherein the passage of the first data signals between the first probe and the waveguide is between said second end of the waveguide and the first probe and the passage of the second data signals between the second probe and the waveguide is from a surface of the at least one protrusion and the second probe.

12. Apparatus according to claim 11 wherein the passage of at least one of the respective first and second data signals is via a microstrip for the respective probes.

13. Apparatus according to claim 1 wherein said at least one protrusion is provided in the form of a bar, rod or plate which passes substantially across the waveguide and which has an upper surface raised from the second end of the waveguide.

14. Apparatus according to claim 13 wherein the at least one protrusion is oriented such that it phase offsets one of the first or second data signals.

15. Apparatus of claim 1 including a transmission line apparatus.

16. Apparatus for the receipt and/or transmission of Radio Frequency data signals, said apparatus including a waveguide to receive said data signals, said waveguide having at least first and second probes depending therefrom and located adjacently to each other wherein a protrusion is provided within the waveguide to cause at least a second set of data signals to be deflected within the waveguide and into a chamber in which the second probe to receive said second set of data signals is located.

17. Apparatus according to claim 16 wherein said first and second probes are located to a common side of the waveguide.

18. Apparatus according to claim 16 wherein the first probe protrudes partially into the waveguide.

19. Apparatus according to claim 16 wherein a PCB includes a second probe for the orthogonal polarisation which transitions the waveguide signal to a microstrip signal.

20. Apparatus for the reception and/or transmission of data signals, said apparatus including a waveguide, said waveguide having an opening at a first end and further having a second opposing closed end wherein a protrusion is formed at or adjacent to said closed end to form a septum, an aperture is provided in the waveguide for the reception and/or transmission of a second set of data signals over a fixed bandwidth which is orthogonally polarised from the bandwidth of a first set of data signals wherein aid aperture transitions to become the waveguide.

21. Apparatus according to claim 20 wherein said waveguide is a circular waveguide.

22. Apparatus according to claim 20 wherein a printed circuit board is provided therein and includes a probe for the reception and/or transmission of the first set of data signals.

23. Apparatus according to claim 22 wherein a ground plane of the PCB is used as a waveguide wall for the second set of data signals.

24. Apparatus according to claim 20 wherein the waveguide has a 90° bend towards a PCB.

* * * * *